US009252569B2

(12) United States Patent
Sakayanagi et al.

(10) Patent No.: US 9,252,569 B2
(45) Date of Patent: Feb. 2, 2016

(54) SPARK PLUG

(71) Applicant: NGK SPARK PLUG CO., LTD., Nagoya-shi, Aichi (JP)

(72) Inventors: Nobuaki Sakayanagi, Toyohashi (JP); Tomoaki Kato, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/443,764

(22) PCT Filed: Nov. 15, 2013

(86) PCT No.: PCT/JP2013/006725

§ 371 (c)(1),
(2) Date: May 19, 2015

(87) PCT Pub. No.: WO2014/076966

PCT Pub. Date: May 22, 2014

(65) Prior Publication Data

US 2015/0288149 A1 Oct. 8, 2015

(30) Foreign Application Priority Data

Nov. 19, 2012 (JP) ..... 2012-252980

(51) Int. Cl.
*H01T 13/32* (2006.01)

(52) U.S. Cl.
CPC ..... *H01T 13/32* (2013.01)

(58) Field of Classification Search
USPC ..... 313/141–145, 11.5; 123/169 EL
See application file for complete search history.

(56) References Cited

U.S. PATENT DOCUMENTS 4,211,952 A * 7/1980 Iwata ..... H01T 13/32 313/143
2013/0200774 A1* 8/2013 Kikai ..... H01T 13/32 313/141
2014/0009058 A1* 1/2014 Hwang ..... H01T 13/16 313/141

FOREIGN PATENT DOCUMENTS

JP 61-13588 A 1/1986
JP 2012-069376 A 4/2012

OTHER PUBLICATIONS

Japanese Patent Office, International Search Report issued in corresponding international application No. PCT/JP2013/006725, mailed Dec. 24, 2013.

* cited by examiner

*Primary Examiner* — Ashok Patel
(74) *Attorney, Agent, or Firm* — Stites & Harbison, PLLC; Jeffrey A. Haeberlin

(57) ABSTRACT

A spark plug includes an insulator; a center electrode; a metallic shell; a ground electrode disposed at a forward end portion of the metallic shell and forming a gap in cooperation with a forward end portion of the center electrode; and a tip at least a portion of which is joined to at least the one of two side surfaces of the ground electrode which is disposed downstream with respect to fuel gas flow. In a first imaginary plane which contains a forward end surface of the center electrode and on which a discharge surface of the tip is projected, at least a portion of a projected image of the discharge surface is located within a range of 2.5G from the outer circumference of the forward end surface of the center electrode, where G (mm) is the size of the gap.

7 Claims, 11 Drawing Sheets

SPARK PLUG

TECHNICAL FIELD

The present invention relates to a spark plug for use in an internal combustion engine or the like.

BACKGROUND ART

A spark plug for use in an internal combustion engine or the like includes, for example, an insulator having an axial hole extending therethrough in the axial direction; a center electrode inserted into a forward end portion of the axial hole; a tubular metallic shell provided on the outer circumference of the insulator; and a rodlike ground electrode fixed to a forward end portion of the metallic shell. Also, a gap is formed between a distal end portion of the ground electrode and a forward end portion of the center electrode for generating spark discharge through application of voltage across the gap.

Furthermore, in recent years, according to a proposed technique for improving resistance to spark-discharge-induced erosion, a tip formed of a metal having excellent durability, such as a noble metal alloy, is joined to a surface (counter surface) of the ground electrode which faces the forward end portion of the center electrode, thereby forming the gap between the tip and the forward end portion of the center electrode (refer to, for example, Patent Document 1).

PRIOR ART DOCUMENT

Patent Document

Patent Document 1: Japanese Patent Application Laid-Open (kokai) No. 2012-69376

SUMMARY OF THE INVENTION

Problem to be Solved by the Invention

However, a fuel gas flow within a combustion chamber could skew spark discharge generated across the gap toward a side surface of the ground electrode adjacent to the counter surface of the ground electrode. As a result of such skewing of spark discharge, spark discharge is generated between a forward end portion of the center electrode and a region on the side surface of the ground electrode in which a tip does not exist; accordingly, the side surface of the ground electrode is rapidly eroded. As a result, voltage required for spark discharge (required voltage) increases abruptly, potentially resulting in occurrence of a failure to generate spark discharge (occurrence of misfire) at a relatively early stage from start of usage.

Furthermore, in the case where a tip is joined to the counter surface of the electrode, fuel gas is apt to directly hit the tip and thus to quickly cool the tip. Quick cooling of the tip increases the thermal stress difference between the tip and the ground electrode. As a result, cracking may occur in a joint between the tip and the ground electrode, potentially resulting in separation of the tip from the ground electrode.

In an internal combustion engine configured such that, in order to improve fuel economy, fuel gas flows at a higher velocity within a combustion chamber, spark discharge is apt to be more intensively skewed by fuel gas flow, and the tip is apt to be cooled more quickly. Thus, a side surface of the ground electrode may be eroded very rapidly, and the tip may easily separate from the ground electrode.

The present invention has been conceived in view of the above circumstances, and an object of the invention is to provide a spark plug which can effectively restrain rapid erosion of a side surface of a ground electrode resulting from skewing of spark discharge and can reliably prevent separation of a tip from the ground electrode.

Means for Solving the Problem

Configurations suitable for achieving the above object will next be described in itemized form. When needed, actions and effects peculiar to the configurations will be described additionally.

Configuration 1. A spark plug of the present configuration comprises a tubular insulator having an axial hole extending therethrough in the direction of an axial line;

a center electrode inserted into a forward end portion of the axial hole;

a tubular metallic shell provided on an outer circumference of the insulator; and a ground electrode disposed at a forward end portion of the metallic shell and adapted to form a gap in cooperation with a forward end portion of the center electrode.

The spark plug is characterized by further comprising a tip at least a portion of which is joined to at least the one of two side surfaces of the ground electrode which is disposed downstream with respect to fuel gas flow, and characterized in that in an imaginary plane which contains a forward end surface of the center electrode and on which a discharge surface of the tip is projected along an axial line, at least a portion of a projected image of the discharge surface is located within a range of 2.5G from an outer circumference of the forward end surface of the center electrode, where G (mm) is a size of the gap.

The "size G of the gap" means a shortest distance from the imaginary plane which contains the forward end surface of the center electrode, to an imaginary plane which contains a surface (counter surface) of the ground electrode disposed in opposition to the center electrode. Also, the "side surface of the ground electrode" means surfaces of the ground electrode adjacent to the counter surface of the ground electrode except for the distal end surface of the ground electrode. Furthermore, the "discharge surface" means a surface of the tip located behind a surface of the tip which faces the joint surface of the ground electrode (the side surface of the ground electrode to which the tip is joined).

Also, the "surface disposed downstream with respect to fuel gas flow" depends on the type of an internal combustion engine, but is generally the one of the side surfaces of the ground electrode adjacent to the counter surface located in opposition to the center electrode which is eroded more than is the other side surface in the case where the two side surfaces are not provided with the tip.

According to configuration 1, the tip is joined to that surface of the ground electrode which is disposed downstream with respect to fuel gas flow. That is, the tip is provided within reach of skewed spark discharge. Also, in the imaginary plane which contains the forward end surface of the center electrode and on which the discharge surface of the tip is projected, at least a portion of a projected image of the discharge surface is located within a range of 2.5G from the outer circumference of the forward end surface of the center electrode. That is, at least a portion of the discharge surface is located in that region of the ground electrode which generates spark discharge in cooperation with the center electrode. By virtue of these configurational features, when fuel gas skews spark discharge, the spark discharge can be more reliably generated between the tip and the center electrode. As a result, there can be effectively restrained rapid erosion of a side surface of the ground electrode resulting from skewing of spark discharge, whereby the occurrence of misfire can be prevented over a long period of time.

Also, configuration 1 can restrain fuel gas from directly hitting the tip, whereby quick cooling of the tip can be more reliably prevented. Therefore, in the course of cooling, the thermal stress difference between the tip and the ground electrode can be effectively reduced. As a result, the occurrence of cracking in the joint between the tip and the ground electrode can be effectively restrained, whereby the separation of the tip from the ground electrode can be more reliably prevented.

Configuration 2. A spark plug of the present configuration is characterized in that, in configuration 1, the tip has a thickness of 0.1 mm or more, and in a second imaginary plane which contains the side surface of the ground electrode provided with the tip and on which a portion of the tip located 0.1 mm or more from a surface of the tip joined to the ground electrode is projected from a direction orthogonal to the axial line, a projected image of the portion has an area of 0.1 $mm^2$ or more.

The "thickness" in "the tip has a thickness of" means the greatest thickness of the tip measured from that surface of the tip which is joined to the side surface of the ground electrode.

Configuration 2 can ensure a sufficient erosion volume for the tip, whereby erosion resistance can be further improved.

Configuration 3. A spark plug of the present configuration is characterized in that, in configuration 1 or 2, a shortest distance from the forward end surface of the center electrode to the discharge surface of the tip along a direction orthogonal to the axial line is +1.5 mm or less, where, with respect to the forward end surface of the center electrode, a + direction is a downstream direction of the fuel gas flow, and a – direction is an upstream direction of the fuel gas flow.

Configuration 3 provides a sufficiently short distance from the forward end surface of the center electrode to the discharge surface of the tip along a skewing direction of spark discharge and, in turn, provides a sufficiently short distance from the forward end surface of the center electrode to the side surface of the ground electrode (the surface to which the tip is joined) along the skewing direction of spark discharge. Therefore, there can be more reliably prevented a disturbance of growth of skewed spark discharge (flame nucleus) by the ground electrode, whereby spark discharge (flame nucleus) can be grown to a greater extent. As a result, excellent ignition performance can be implemented.

Configuration 4. A spark plug of the present configuration is characterized in that, in any one of configurations 1 to 3, a portion of the tip is disposed on at least one of a counter surface of the ground electrode located toward the center electrode and a back surface of the ground electrode located behind the counter surface.

Configuration 4 can further enhance the strength of joining the tip to the ground electrode, whereby separation resistance of the tip can be further improved.

Configuration 5. A spark plug of the present configuration is characterized in that, in any one of configurations 1 to 4, a portion of the tip protrudes toward the center electrode from a counter surface of the ground electrode located toward the center electrode.

According to configuration 5, when spark discharge is skewed by fuel gas flow, spark discharge can be generated more reliably between the tip and the center electrode. As a result, erosion of the ground electrode resulting from spark discharge can be prevented further reliably.

Also, when spark discharge is skewed by fuel gas flow, spark discharge can be brought into contact with that portion of the tip which protrudes from the counter surface, whereby further extension of skewed spark discharge can be prevented. By virtue of this, spark discharge can be maintained over a longer period of time, whereby the occurrence of misfire can be effectively restrained. As a result, ignition performance can be further improved.

Configuration 6. A spark plug of the present configuration is characterized in that, in any one of configurations 1 to 5, the tip is joined only to the one of the two side surfaces of the ground electrode which is disposed downstream with respect to the fuel gas flow.

Provision of the tip on both of the side surfaces of the ground electrode provides the following advantage: even when the position of the spark plug mounted on an internal combustion engine or the like deviates from a regular position (e.g., the spark plug is mounted to the internal combustion engine or the like in a condition of angular displacement from the regular position), the one of the side surfaces of the ground electrode which is disposed downstream with respect to fuel gas flow can reliably have the tip joined thereto.

However, the provision of the tip on both of the side surfaces of the ground electrode may possibly raise a problem in that the tip disposed upstream with respect to fuel gas flow hinders inflow of fuel gas into the gap. Also, the tip disposed upstream with respect to fuel gas flow is apt to be quickly cooled by fuel gas and is thus apt to be separated. Additionally, as a result of entry of the separated tip into the gap, misfire may possibly arise. Furthermore, an increase in cost as a result of provision of a plurality of tips is of concern.

In this connection, according to configuration 6, the tip is joined only to that side surface of the ground electrode which is disposed downstream with respect to fuel gas flow. Accordingly, fuel gas can smoothly flow into the gap, whereby ignition performance can be further improved. Also, the occurrence of misfire resulting from separation of the tip can be more reliably prevented, and costs can be reduced.

Configuration 7. A spark plug mounting structure of the present configuration is an internal combustion engine to which the spark plug of any one of configurations 1 to 6 is mounted, and is characterized in that the tip is joined to at least the one of two side surfaces of the ground electrode which is disposed downstream with respect to fuel gas flow.

The mounting structure of configuration 7 can restrain fuel gas from directly hitting the tip, whereby quick cooling of the tip can be more reliably prevented. Therefore, in the course of cooling, the thermal stress difference between the tip and the ground electrode can be effectively reduced. As a result, the occurrence of cracking in the joint between the tip and the ground electrode can be effectively restrained, whereby the separation of the tip from the ground electrode can be more reliably prevented.

MODES FOR CARRYING OUT THE INVENTION

Figure 1:
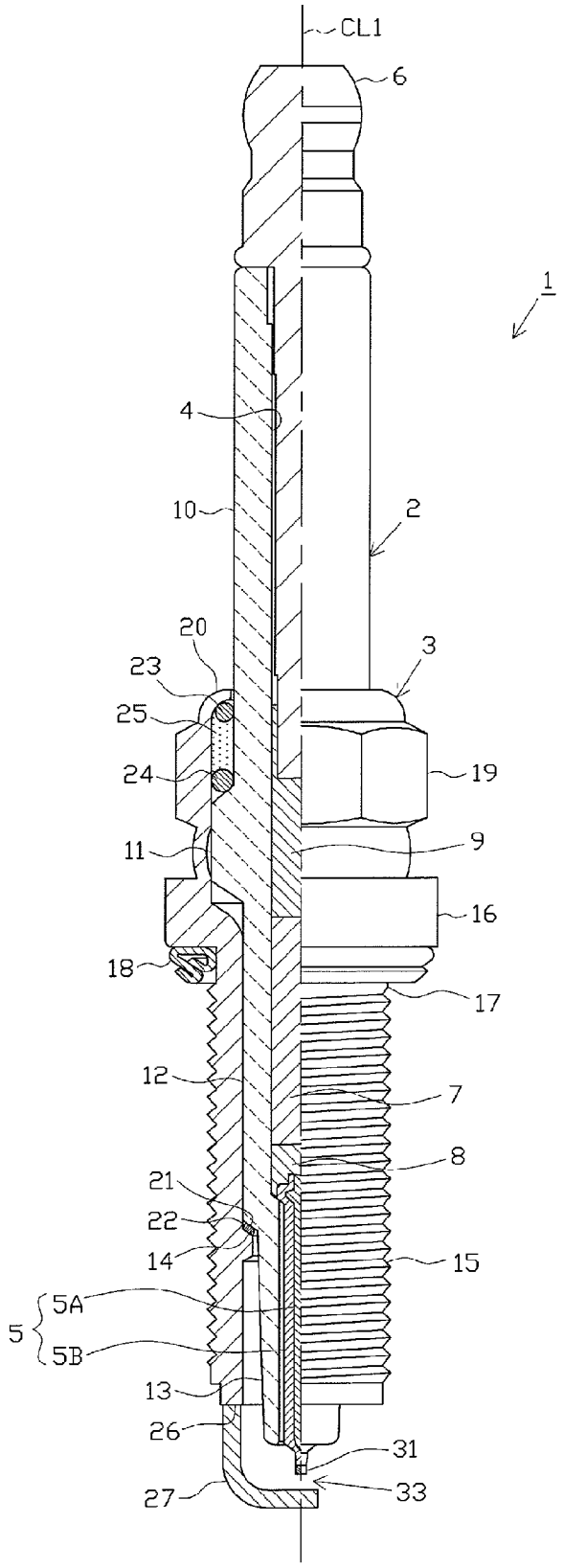
FIG. 1 Partially cutaway front view showing the configuration of a spark plug.

FIG. 1 is a partially cutaway front view showing a spark plug 1. In FIG. 1, the direction of an axial line CL1 of the spark plug 1 is referred to as the vertical direction. In the following description, the lower side of the spark plug 1 in FIG. 1 is referred to as the forward side of the spark plug 1, and the upper side as the rear side.

The spark plug 1 includes a tubular ceramic insulator 2, which corresponds to the insulator in the present invention, and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed at its rear side; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, while the large-diameter portion 11, the intermediate trunk portion 12, and most of the leg portion 13 of the ceramic insulator 2 are accommodated within the metallic shell 3, a forward end portion of the ceramic insulator 2 protrudes forward from the forward end of the metallic shell 3. A tapered, stepped portion 14 is formed at a connection portion between the intermediate trunk portion 12 and the leg portion 13. The ceramic insulator 2 is seated on the metallic shell 3 at the stepped portion 14.

Furthermore, the ceramic insulator 2 has an axial hole 4 extending therethrough along the axial line CL1. A center electrode 5 is inserted into a forward end portion of the axial hole 4. The center electrode 5 includes an inner layer 5A formed of a metal having excellent thermal conductivity [e.g., copper, a copper alloy, or pure nickel (Ni)], and an outer layer 5B formed of an alloy which contains nickel as a main component. Furthermore, the center electrode 5 assumes a rodlike (circular columnar) shape as a whole and protrudes from the forward end of the ceramic insulator 2. Also, a circular columnar center-electrode-side tip 31 formed of a predetermined metal [e.g., iridium (Ir), platinum (Pt), rhodium (Rh), ruthenium (Ru), rhenium (Re), tungsten (W), palladium (Pd), or an alloy which contains at least one of these metals as a main component] and having a flat end surface is provided at a forward end portion of the center electrode 5.

Also, an electrode terminal 6 is fixedly inserted into the rear side of the axial hole 4 in such a condition as to protrude from the rear end of the ceramic insulator 2.

Furthermore, a circular columnar resistor 7 is disposed within the axial hole 4 between the center electrode 5 and the electrode terminal 6. The resistor 7 is electrically connected, at its opposite ends, to the center electrode 5 and the electrode terminal 6 through glass seal layers 8 and 9, respectively.

Additionally, the metallic shell 3 is formed into a tubular shape from a low-carbon steel or a like metal. The metallic shell 3 has, on its outer circumferential surface, a threaded portion (externally threaded portion) 15 adapted to mount the spark plug 1 into a mounting hole of an internal combustion engine or the like. Also, the metallic shell 3 has a collar-like seat portion 16 located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the internal combustion engine or the like. Also, the metallic shell 3 has a crimped portion 20 provided at a rear end portion thereof for holding the ceramic insulator 2.

Also, the metallic shell 3 has, on its inner circumferential surface, a tapered, stepped portion 21 adapted to allow the ceramic insulator 2 to be seated thereon. The ceramic insulator 2 is inserted forward into the metallic shell 3 from the rear end of the metallic shell 3. In a condition in which the stepped portion 14 of the ceramic insulator 2 butts against the stepped portion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the stepped portions 14 and 21. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 through the sheet packing 22, the ring members 23 and 24, and the talc 25.

Figure 2:
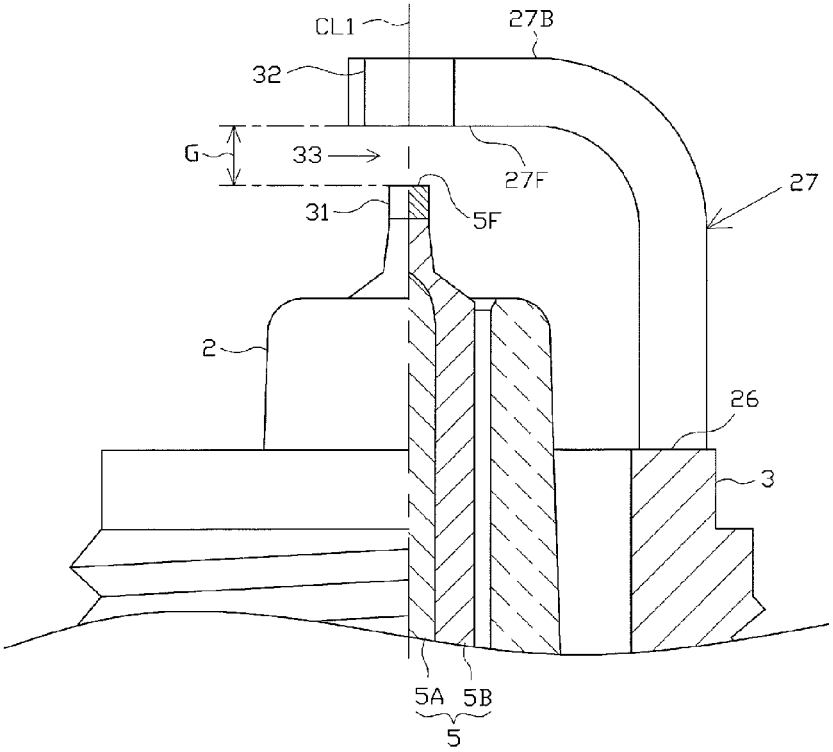
FIG. 2 Partially cutaway enlarged front view showing the configuration of a forward end portion of the spark plug.
Figure 3:
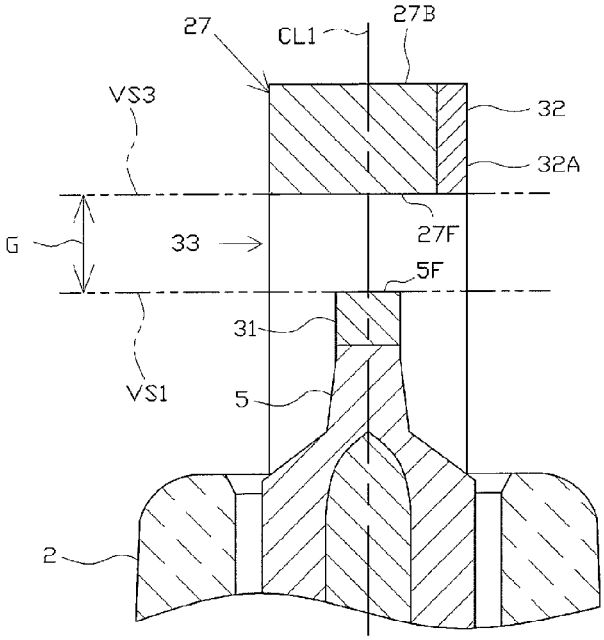
FIG. 3 Enlarged sectional view showing the configuration of the forward end portion of the spark plug.

Also, as shown in FIG. 2, a rodlike ground electrode 27 is joined to a forward end portion 26 of the metallic shell 3 and is bent at its substantially intermediate portion such that its distal end portion faces a forward end portion (center-electrode-side tip 31) of the center electrode 5. The ground electrode 27 is formed of an alloy which contains Ni as a main component (e.g., an alloy which contains Ni as a main component, and at least one of silicon, aluminum, and rare-earth elements), and a gap 33 is formed between the distal end portion of the ground electrode 27 and the forward end portion (center-electrode-side tip 31) of the center electrode 5. In the present embodiment, the size G of the gap 33 falls within a predetermined range (e.g., 0.2 mm to 2 mm). The "size G of the gap 33" means, as shown in FIG. 3, the shortest distance from a first imaginary plane VS1 (which corresponds to "imaginary plane" in the present invention) which contains a forward end surface 5F of the center electrode 5, to a third imaginary plane VS3 which contains a counter surface 27F of the ground electrode 27 disposed in opposition to the forward end surface 5F of the center electrode 5.

Figure 4:
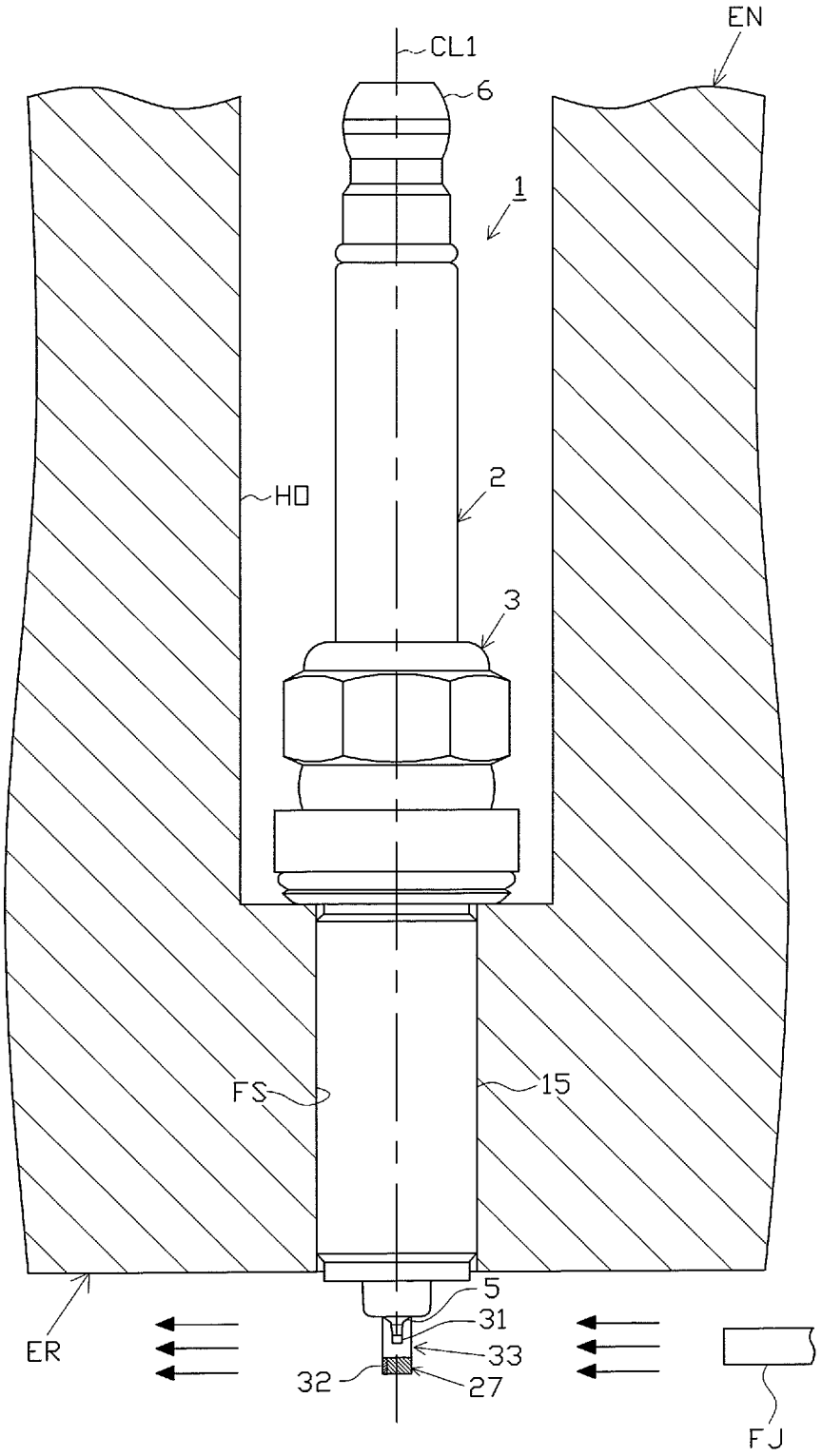
FIG. 4 Schematic view showing the spark plug mounted to an internal combustion engine.

Also, in the present embodiment, as shown in FIG. 4 (the bold-line arrows in FIG. 4 indicate the direction of fuel gas flow), the relative position of the thread-cutting start or end position of the threaded portion 15 to a position of joining the ground electrode 27 to the metallic shell 3 is determined in relation to, for example, the thread-cutting start position of an internally threaded portion FS of a mounting hole HO of an internal combustion engine EN. By this practice, when the spark plug 1 is mounted to the internal combustion engine EN, the ground electrode 27 is not disposed between the gap 33 and a fuel supply device FJ for supplying fuel gas to a combustion chamber ER. Thus, there can be prevented a hindrance to supply of fuel gas to the gap 33 resulting from existence of the ground electrode 27, and the generation of turbulence in fuel gas flowing through the gap 33, whereby good ignition performance can be implemented. In the present embodiment, in order to improve fuel economy, etc., the internal combustion engine EN is configured such that fuel gas flows within the combustion chamber ER at a relatively high velocity (e.g., 10 m/s or more).

Figure 5:
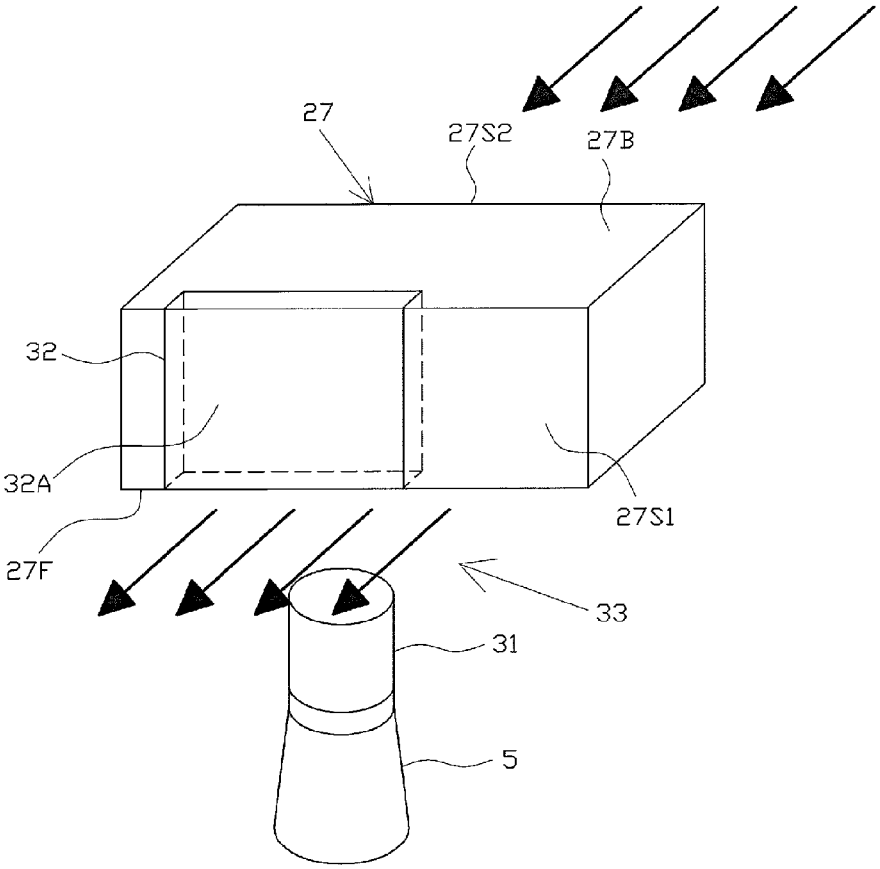
FIG. 5 Fragmentary enlarged perspective view showing a ground-electrode-side tip, etc.

Furthermore, in order to dispose the ground electrode 27 at the above-mentioned position when the spark plug 1 is mounted to the internal combustion engine EN, as shown in FIG. 5 (the bold-line arrows in FIG. 5 indicate the direction of fuel gas flow), one of two side surfaces 27S1 and 27S2 of the ground electrode 27 is disposed upstream with respect to fuel gas flow, and the other one is disposed downstream. Thus, when spark discharge is generated through application of voltage across the gap 33, fuel gas may skew spark discharge. When spark discharge is skewed by fuel gas flow, spark discharge is generated between the side surface of the ground electrode 27 disposed downstream with respect to fuel gas flow and a forward end portion of the center electrode 5 (center-electrode-side tip 31). As a result, spark discharge may cause eccentrically excessive erosion of the side surface of the ground electrode 27 disposed downstream with respect to fuel gas flow.

Thus, in the present embodiment, in order to prevent unbalanced erosion of the ground electrode 27, a rectangular-parallelepiped ground-electrode-side tip 32 is joined to at least the one of the two side surfaces 27S1 and 27S2 of the ground electrode 27 which is disposed downstream with respect to fuel gas flow (in the present embodiment, to the side surface 27S1). The ground-electrode-side tip 32 is formed of a metal having excellent erosion resistance (e.g., Ir, Pt, Rh, Ru, Re, W, Pd, or an alloy which contains at least one of these metals as a main component), and is joined to the ground electrode 27 by, for example, resistance welding in such a condition as to be embedded in the ground electrode 27. Also, in the present embodiment, the ground-electrode-side tip 32 is joined only to the side surface 27S1 disposed downstream with respect to fuel gas flow. Furthermore, a surface of the ground-electrode-side tip 32 located toward the center electrode 5 is flush with the counter surface 27F of the ground electrode 27.

Figure 6:
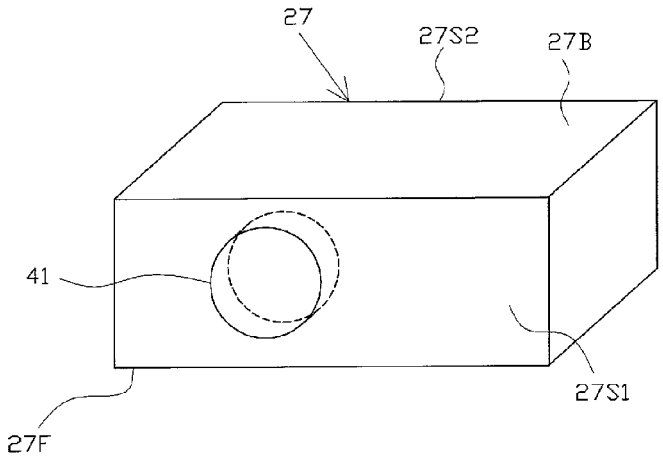
FIG. 6 Fragmentary enlarged perspective view showing another example of the ground-electrode-side tip.

No particular limitation is imposed on the shape of the ground-electrode-side tip 32. For example, as shown in FIG. 6, the ground-electrode-side tip 41 may have a circular columnar shape.

Figure 7:
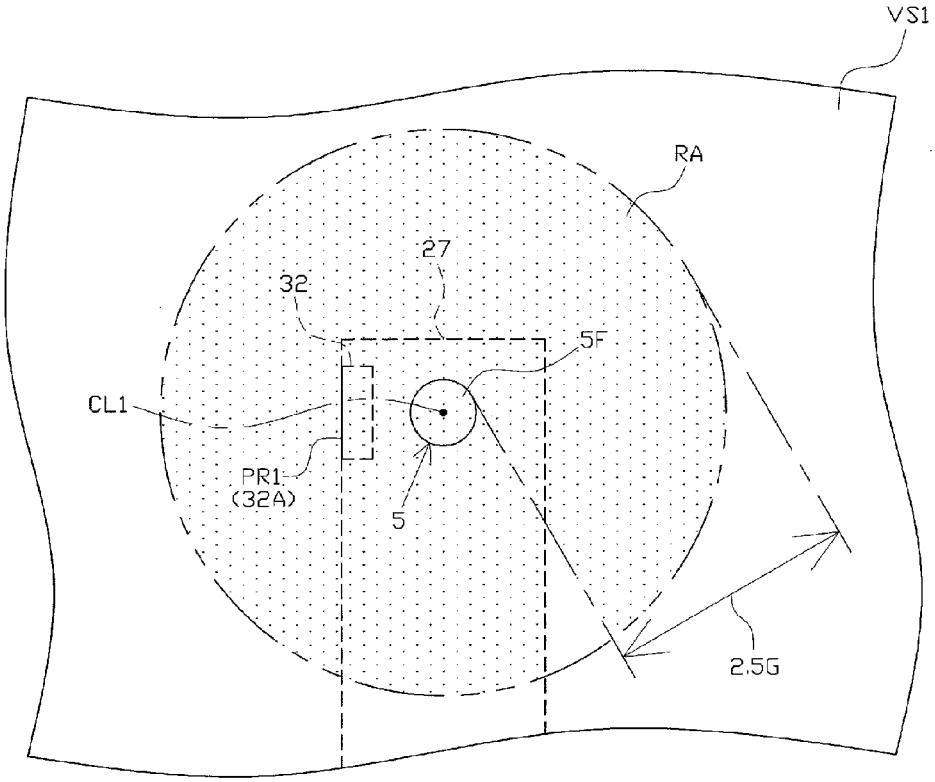
FIG. 7 Projection view showing a projected image of a discharge surface projected on a first imaginary plane, etc.

Additionally, in the present embodiment, as shown in FIG. 7, in the first imaginary plane VS1 on which the discharge surface 32A of the ground-electrode-side tip 32 is projected along the axial line CL1, at least a portion of a projected image PR1 (in FIG. 7, represented with the bold line) of the discharge surface 32A is located within a range RA (in FIG. 7, represented by dots) of 2.5G from the outer circumference of the forward end surface 5F of the center electrode 5. The "discharge surface 32A" means a surface of the ground-electrode-side tip 32 located behind a surface of the ground-electrode-side tip 32 which faces a joint surface (the side surface 27S1 in the present embodiment) of the ground electrode 27 (the one of the side surfaces 27S1 and 27S2 of the ground electrode 27 which is disposed downstream with respect to fuel gas flow and to which the ground-electrode-side tip 32 is joined) as shown in FIG. 5, etc.

Figure 8:
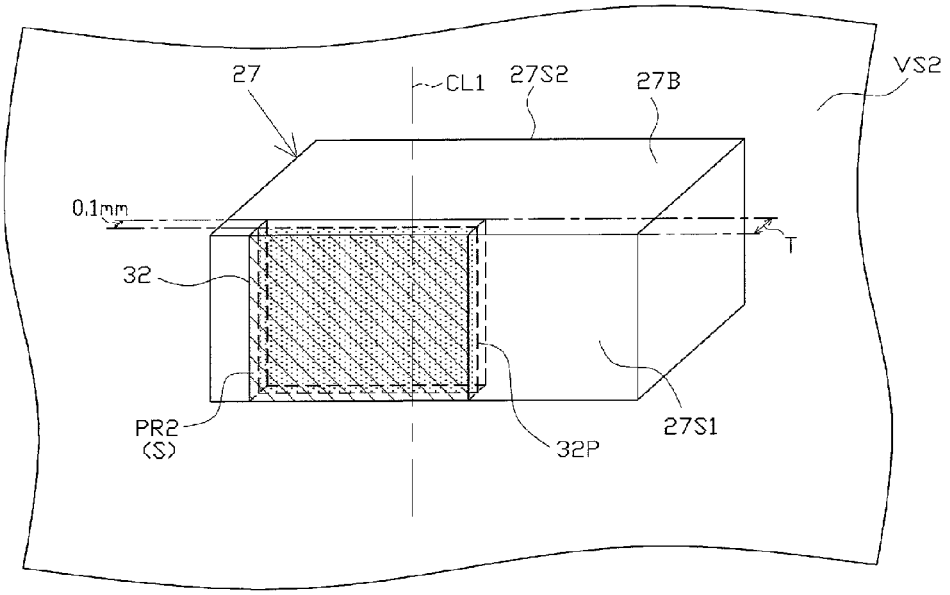
FIG. 8 Schematic view showing the thickness of the ground-electrode-side tip, etc.

Also, as shown in FIG. 8, the ground-electrode-side tip 32 has a thickness T (more specifically, a greatest thickness measured from that surface of the ground-electrode-side tip 32 which is joined to the side surface 27S1) of 0.1 mm or more.

Furthermore, in a second imaginary plane VS2 which contains the side surface 27S1 (a surface to which the tip 32 is joined) of the ground electrode 27 and on which a portion 32P (in FIG. 8, represented by dots) of the ground-electrode-side tip 32 located 0.1 mm or more along the thickness direction of the ground-electrode-side tip 32 from a surface of the ground-electrode-side tip 32 joined to the ground electrode 27 is projected from a direction orthogonal to the axial line CL1, a projected image PR2 (in FIG. 8, represented by slashes) of the portion 32P has an area S of 0.1 $mm^2$ or more. That is, the ground-electrode-side tip 32 has a sufficiently large thickness, and a portion of the ground-electrode-side tip 32 located toward the discharge surface 32A has a sufficiently large sectional area.

Figure 9:
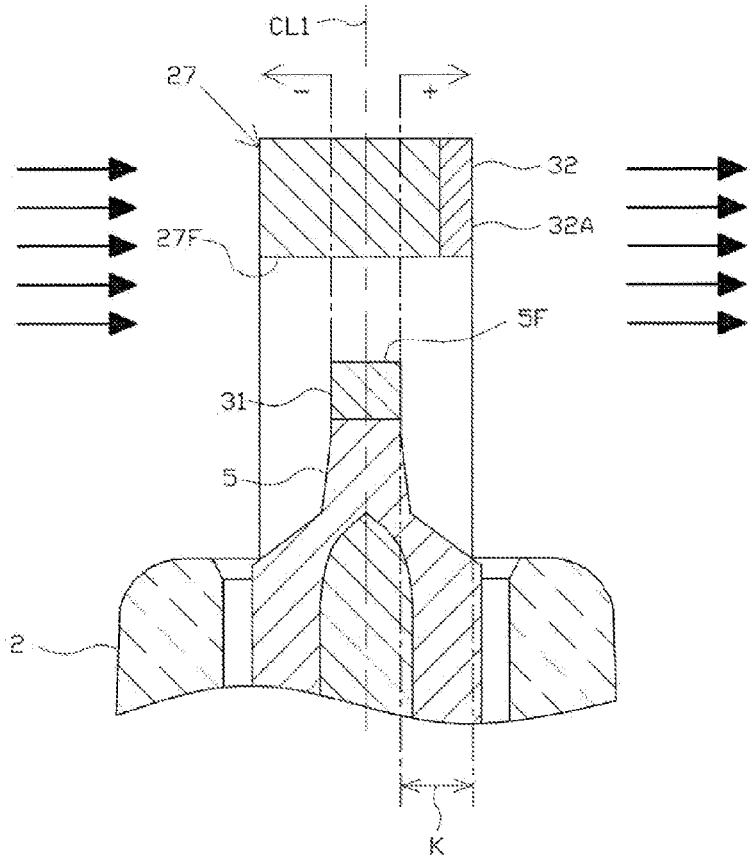
FIG. 9 Enlarged sectional view for explaining shortest distance K.

Furthermore, as shown in FIG. 9 (the bold-line arrows in FIG. 9 indicate the direction of fuel gas flow), a shortest distance K from the forward end surface 5F of the center electrode 5 to the discharge surface 32A along a direction orthogonal to the axial line CL1 is +1.5 mm or less, where, with respect to the forward end surface 5F of the center electrode 5, a + direction is a downstream direction of the fuel gas flow, and a – direction is an upstream direction of the fuel gas flow. That is, the configuration is such that the growth of spark discharge (flame nucleus) skewed by fuel gas flow is not restrained by the ground electrode 27 to the greatest possible extent. In the case where the discharge surface 32A is located above the forward end surface 5F of the center electrode 5 (more specifically, in the case where the discharge surface 32A is located on or radially inward of an imaginary surface formed by extending the outer circumference of the forward end surface 5F along the axial line CL1), the shortest distance K is 0.0 mm.

As described in detail above, according to the present embodiment, the ground-electrode-side tip 32 is joined to the side surface 27S1 of the ground electrode 27 which is disposed downstream with respect to fuel gas flow. That is, the ground-electrode-side tip 32 is provided within reach of skewed spark discharge. Also, in the first imaginary plane VS1 on which the discharge surface 32A is projected, at least a portion of the projected image PR1 of the discharge surface 32A is located within a range RA of 2.5G from the outer circumference of the forward end surface 5F of the center electrode 5. That is, at least a portion of the discharge surface 32A is located in that region of the ground electrode 27 which generates spark discharge in cooperation with the center electrode 5. By virtue of these configurational features, when fuel gas skews spark discharge, the spark discharge can be generated between the ground-electrode-side tip 32 and the center electrode 5. As a result, there can be effectively restrained rapid erosion of the side surface 27S1 of the ground electrode 27 resulting from skewing of spark discharge, whereby the occurrence of misfire can be prevented over a long period of time.

Also, the present embodiment can restrain fuel gas from directly hitting the ground-electrode-side tip 32, whereby quick cooling of the ground-electrode-side tip 32 can be more reliably prevented. Therefore, in the course of cooling, the thermal stress difference between the ground electrode 27 and the ground-electrode-side tip 32 can be effectively reduced. As a result, the occurrence of cracking in the joint between the ground electrode 27 and the ground-electrode-side tip 32 can be effectively restrained, whereby the separation of the ground-electrode-side tip 32 can be more reliably prevented.

Particularly, as in the case of the present embodiment, in the case where the spark plug 1 is mounted to the internal combustion engine EN configured such that fuel gas flows at a high velocity (e.g., 10 m/s or more), unbalanced erosion of the ground electrode 27 and the separation of the ground-electrode-side tip 32 are of greater concern. However, the employment of the above configurational features can more reliably prevent the occurrence of unbalanced erosion of the ground electrode 27 and separation of the ground-electrode-side tip 32. In other words, joining the ground-electrode-side tip 31 to at least the one of the two side surfaces 27S1 and 27S2 of the ground electrode 27 which is disposed downstream with respect to fuel gas flow is particularly effective for a spark plug for use in the internal combustion engine EN configured such that fuel gas flows at a high velocity (e.g., 10 m/s or more).

Additionally, in the present embodiment, the ground-electrode-side tip 32 has a thickness T of 0.1 mm or more and an area S of 0.1 $mm^2$ or more. Therefore, a sufficient erosion volume can be ensured for the ground-electrode-side tip 32, whereby erosion resistance can be further improved.

Furthermore, the shortest distance K is specified as +1.5 mm or less, thereby providing a sufficiently short distance from the forward end surface 5F of the center electrode 5 to the side surface 27S1 of the ground electrode 27 along a skewing direction of spark discharge. Therefore, there can be more reliably prevented a disturbance of growth of skewed spark discharge (flame nucleus) by the ground electrode 27, whereby spark discharge (flame nucleus) can be grown to a greater extent. As a result, excellent ignition performance can be implemented.

Additionally, since the ground-electrode-side tip 32 is joined only to that side surface 27S1 of the ground electrode 27 which is disposed downstream with respect to fuel gas flow, fuel gas can smoothly flow into the gap 33, whereby ignition performance can be further improved.

Next, in order to verify actions and effects to be yielded by the embodiment described above, there were manufactured sample 1 (corresponding to Comparative Example) in which the ground-electrode-side tip was joined to the counter surface of the ground electrode, and sample 2 (corresponding to Example) in which the ground-electrode-side tip was joined to that side surface of the ground electrode which was disposed downstream with respect to fuel gas flow. Samples 1 and 2 were subjected to a desktop temperature cycle test. The desktop temperature cycle test is outlined below. The samples were subjected to 1,000 test cycles in the atmosphere, each test cycle consisting of heating by a burner for two minutes such that the ambient temperature of the ground-electrode-side tip became 1,000° C., and subsequent blowing of air simulating fuel gas for one minute against a side surface of the ground electrode (regarding sample 2, against a side surface opposite the side surface to which the tip was joined). After completion of 1,000 test cycles, the sections of the samples were observed to measure the percentage of the length of oxide scale formed at a boundary portion between the ground electrode and the ground-electrode-side tip to the length of the boundary portion (percentage of oxide scale). Table 1 shows the percentages of oxide scale of the samples.

In the samples, the forward end surface of the center electrode had an outside diameter of 0.8 mm. The ground electrode had a thickness of 1.5 mm and a width of 2.8 mm. The ground-electrode-side tip assumed a circular columnar shape and had a thickness of 0.3 mm and an outside diameter of 0.7 mm.

TABLE 1

| | Percentage of oxide scale |
|---|---|
| Sample 1 | 50% |
| Sample 2 | 70% |

As shown in Table 1, sample 2 exhibits a sufficiently low percentage of oxide scale, indicating that sample 2 can more reliably prevent separation of the ground-electrode-side tip from the ground electrode. Conceivably, this is for the following reason: quick cooling of the ground-electrode-side tip by air (fuel gas) was restrained; as a result, the thermal stress difference between the ground electrode and the ground-electrode-side tip was effectively reduced.

As is understood from the above test results, in order to prevent separation of the ground-electrode-side tip, preferably, the ground-electrode-side tip is joined to the one of two side surfaces of the ground electrode which is disposed downstream with respect to fuel gas flow.

Next, there were fabricated spark plug samples which had a gap size G of 0.8 mm, 1.1 mm, or 1.5 mm and connected to a power supply unit in such a manner that spark discharge was generated with the center electrode and the ground electrode having negative polarity and positive polarity, respectively. Next, while air was blown against the gaps at a velocity of 10 m/s or more, voltage was applied to the samples in the atmosphere of 1 MPa (the applied voltage had a frequency of 100 Hz, and spark discharge was generated 6,000 times per minute). There was identified that portion of the ground electrode which formed spark discharge in cooperation with the center electrode and which was most distant from the outer circumference of the forward end surface of the center electrode. The distance (discharge generation distance) from the identified portion to the outer circumference of the forward end surface of the center electrode along a direction orthogonal to the axial line was measured. The discharge generation distance corresponds to that region of the ground electrode which can generate spark discharge in cooperation with the center electrode (i.e., a region which could be eroded by spark discharge).

Figure 10:
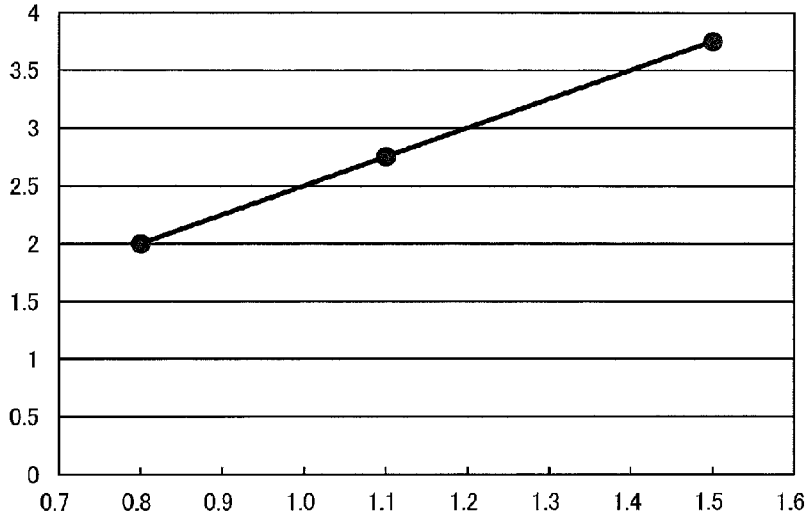
FIG. 10 Graph showing the relation between a discharge generation distance and a gap size.

FIG. 10 is a graph showing the relation between the gap size G and the discharge generation distance. The samples had an outside diameter of the forward end surface of the center electrode of 0.8 mm. The ground electrode had a thickness of 1.5 mm and a width of 2.8 mm. The ground-electrode-side tip assumed a circular columnar shape and had a thickness of 0.3 mm and an outside diameter of 0.7 mm.

As shown in FIG. 10, it was confirmed that the discharge generation distance was 2.5 times the gap size G. That is, the following has been confirmed: erosion resulting from spark discharge could occur at that portion of the ground electrode which is located within an imaginary surface formed by projecting forward in the axial direction an annular range extending from the outer circumference of the forward end surface of the center electrode to a circle located 2.5G away from the outer circumference.

As is understood from the above test results, preferably, the ground-electrode-side tip is provided such that at least a portion of the discharge surface of the ground-electrode-side tip is located at that portion of the ground electrode which is located within the imaginary surface. In other words, preferably, in an imaginary plane which contains the forward end surface of the center electrode and on which the discharge surface of the ground-electrode-side tip is projected along the axial line, at least a portion of a projected image of the discharge surface is located within a range of 2.5G from the outer circumference of the forward end surface of the center electrode.

Next, a tipless sample, a tip-furnished sample A, and a tip-furnished sample B were fabricated and were then subjected to a desktop spark endurance test. The desktop spark endurance test is outlined below. The samples were connected to a power supply unit in such a manner that spark discharge was generated with the center electrode and the ground electrode having negative polarity and positive polarity, respectively. In this condition, while air was blown against the gaps at a velocity of 10 m/s or more, voltage was applied to the samples in the atmosphere of 1 MPa (the applied voltage had a frequency of 100 Hz, and spark discharge was generated 6,000 times per minute) for up to 100 hours. The samples were measured for discharge voltage at predetermined intervals of time.

Figure 11:
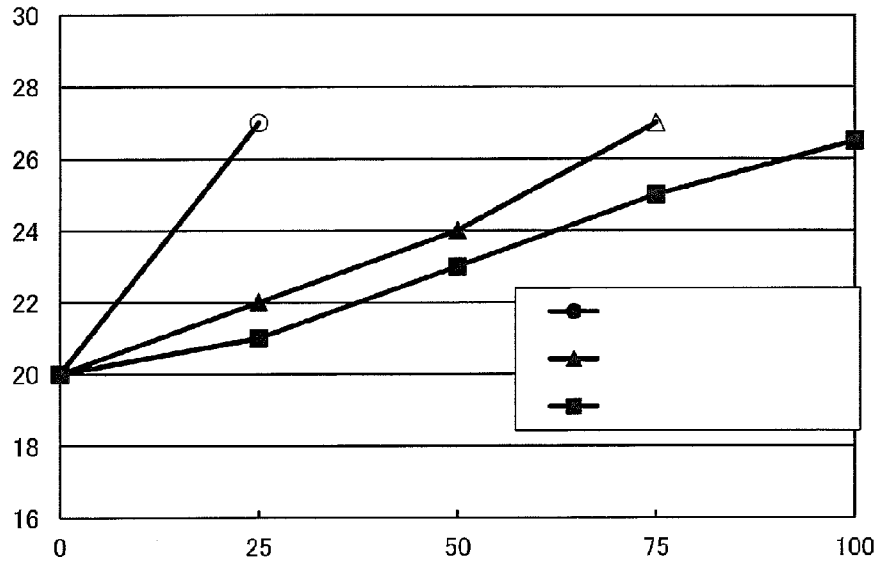
FIG. 11 Graph showing variation of discharge voltage with time.

FIG. 11 shows the results of the test. In FIG. 11, a circle indicates the test result of the tipless sample; triangles indicate the test results of the tip-furnished sample A; and squares indicate the test results of the tip-furnished sample B. Also, in FIG. 11, outlined marks indicate the occurrence of misfire.

The tipless sample is a spark plug sample having no ground-electrode-side tip. The tip-furnished sample A is a spark plug sample having the ground-electrode-side tip provided on that side surface of the ground electrode which is disposed downstream with respect to a flow of fuel gas (air in the present test), and having a thickness T of the ground-electrode-side tip of 0.1 mm and an area S of 0.05 $mm^2$. The tip-furnished sample B is a spark plug sample having the ground-electrode-side tip provided on that side surface of the ground electrode which is disposed downstream with respect to a flow of fuel gas (air in the present test), and having a thickness T of the ground-electrode-side tip of 0.1 mm and an area S of 0.1 $mm^2$.

As shown in FIG. 11, the sample having a thickness T of 0.1 mm and an area S of 0.1 $mm^2$ (tip-furnished sample B) is free of occurrence of misfire even when discharge is generated for 100 hours, indicating that the sample has an excellent effect of restraining an increase in discharge voltage.

As is understood from the above test results, in view of effective restraint of increase in discharge voltage through improvement of erosion resistance, preferably, the ground-electrode-side tip has a thickness T of 0.1 mm or more and an area S of 0.1 $mm^2$ or more.

Figure 12:
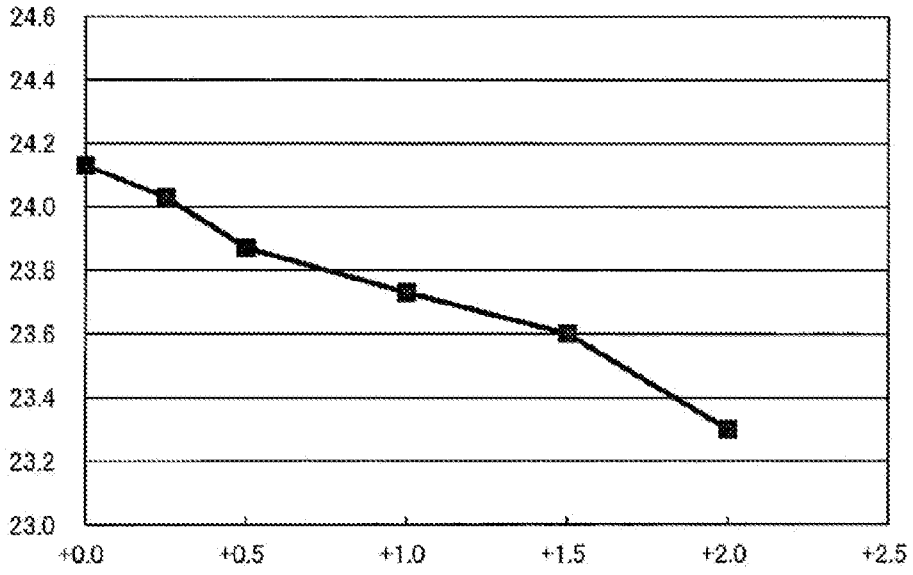
FIG. 12 Graph showing the relation between the shortest distance K and limit air-fuel ratio.

Next, there were fabricated spark plug samples which differed in the shortest distance K from the forward end surface of the center electrode to the discharge surface of the ground-electrode-side tip along a direction orthogonal to the axial line, where, with respect to the forward end surface of the center electrode, a + direction is a downstream direction of fuel gas flow, and a – direction is an upstream direction of fuel gas flow. The samples were subjected to an ignition limit evaluation test. The ignition limit evaluation test is outlined below. The samples were mounted to a predetermined engine. While the engine was operated at a speed of 2,000 rpm, the air-fuel ratio (A/F) of fuel gas was gradually reduced. The samples were measured for an air-fuel ratio (limit air-fuel ratio) at which misfire occurred 10 times when voltage was applied to the samples 1,000 times. FIG. 12 shows the results of the test. The higher the limit air-fuel ratio, the more superior the ignition performance.

As shown in FIG. 12, at a shortest distance K of +1.5 mm or less, the limit air-fuel ratio increases greatly, indicating that excellent ignition performance can be implemented. Conceivably, this is for the following reason: a disturbance of growth of spark discharge by the ground electrode was effectively restrained.

As is understood from the above test results, in order to implement excellent ignition performance, preferably, the shortest distance K from the forward end surface of the center electrode to the discharge surface of the ground-electrode-side tip along a direction orthogonal to the axial line is +1.5 mm or less.

The present invention is not limited to the above embodiment, but may be embodied, for example, as follows. Of course, applications and modifications other than those exemplified below are also possible.

Figure 13:
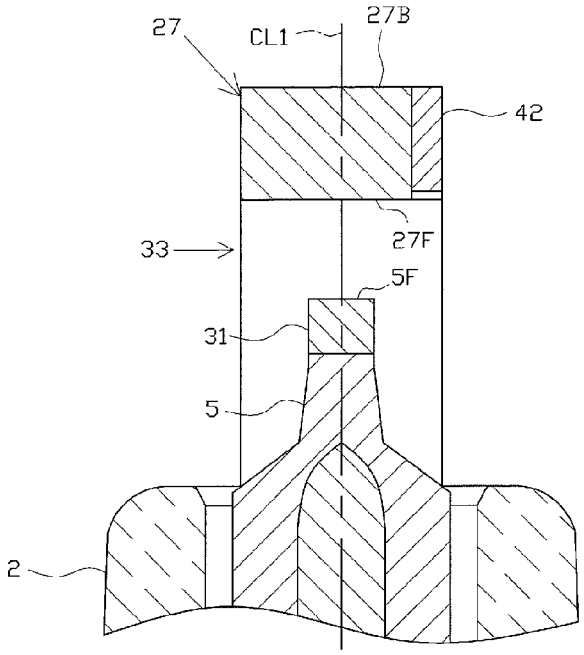
FIG. 13 Enlarged sectional view showing the configuration of a ground-electrode-side tip in another embodiment.

(a) In the above embodiment, a surface of the ground-electrode-side tip 32 located toward the center electrode 5 is flush with the counter surface 27F of the ground electrode 27. However, the position of the ground-electrode-side tip 32 in relation to the counter surface 27F is not limited thereto. For example, as shown in FIG. 13, the entire ground-electrode-side tip 42 may be shifted from the counter surface 27F away from the center electrode 5.

In such a configuration, in view of reliable prevention of erosion of the ground electrode 27, preferably, a surface of the ground-electrode-side tip located toward the center electrode 5 is brought sufficiently close to the counter surface 27F. Therefore, the distance between the counter surface 27F and a surface of the ground-electrode-side tip located toward the center electrode 5 is preferably half or less of the thickness of that portion of the ground electrode 27 to which the ground-electrode-side tip is joined, more preferably ¼ or less of the thickness.

Figure 14:
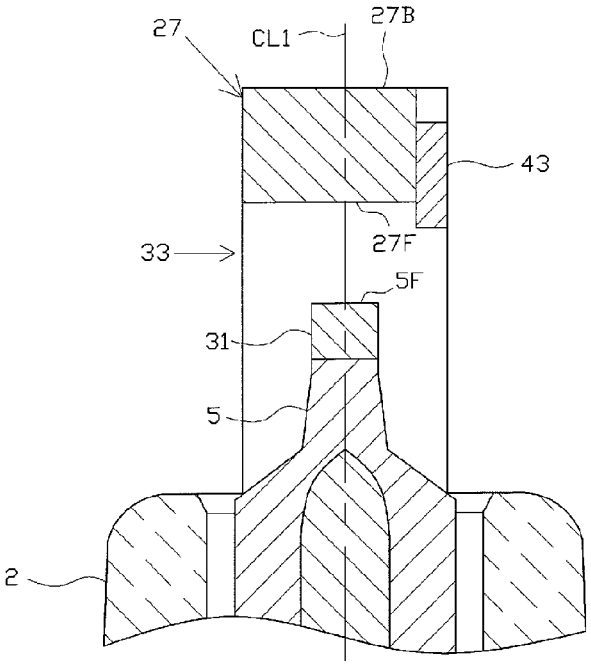
FIG. 14 Enlarged sectional view showing the configuration of a ground-electrode-side tip in a further embodiment.

Also, as shown in FIG. 14, a portion of the ground-electrode-side tip 43 may protrude toward the center electrode 5 from the counter surface 27F. Through employment of such a configuration, in the event of skewing of spark discharge, spark discharge can be more reliably generated between the ground-electrode-side tip 43 and the center electrode 5. As a result, erosion of the ground electrode 27 resulting from spark discharge can be further reliably prevented. Also, when spark discharge is skewed by fuel gas flow, spark discharge can be brought into contact with that portion of the ground-electrode-side tip 43 which protrudes from the counter surface 27F, whereby further extension of skewed spark discharge can be prevented. By virtue of this, spark discharge can be maintained over a longer period of time, whereby the occurrence of misfire can be effectively restrained. As a result, ignition performance can be further improved.

Figure 15:
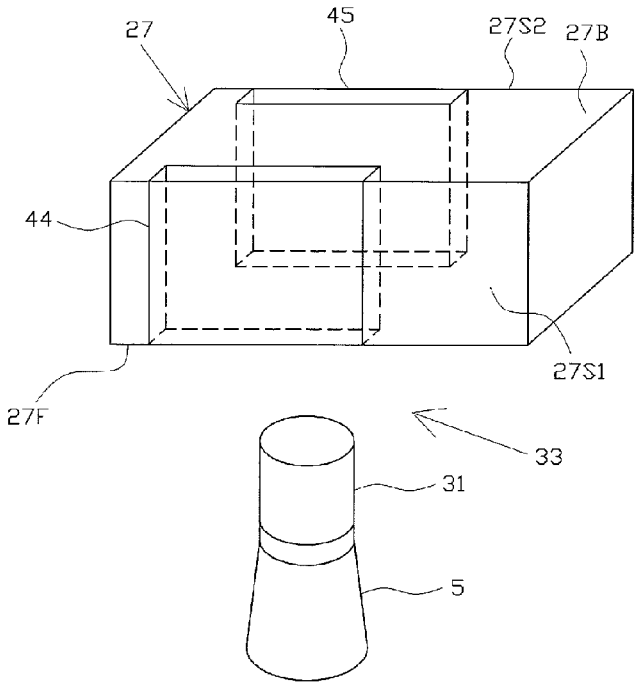
FIG. 15 Enlarged sectional view showing the configuration of a ground-electrode-side tip in a still further embodiment.
Figure 16:
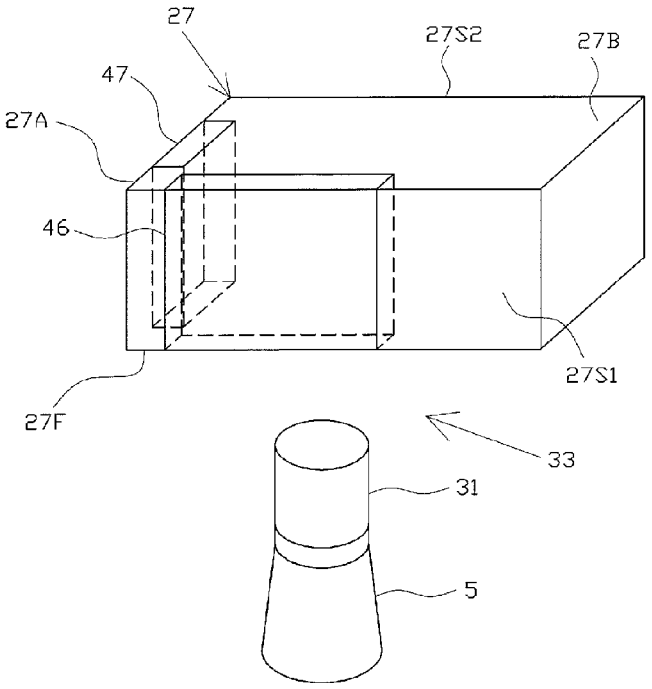
FIG. 16 Enlarged sectional view showing the configuration of a ground-electrode-side tip in yet another embodiment.

(b) In the above embodiment, the ground-electrode-side tip 32 is joined only to the side surface 27S1 of the ground electrode 27. However, as shown in FIG. 15, ground-electrode-side tips 44 and 45 may be joined to the two side surfaces 27S1 and 27S2, respectively. Also, as shown in FIG. 16, the following configuration may be employed: a ground-electrode-side tip 46 is joined to at least the one of the side surfaces 27S1 and 27S2 of the ground electrode 27 which is disposed downstream with respect to fuel gas flow, and a distal-end-surface tip 47 formed of a predetermined metal (e.g., Ir, Pt, Rh, Ru, Re, W, Pd, or an alloy which contains at least one of these metals as a main component) is joined to the forward end surface 27A of the ground electrode 27.

Figure 17:
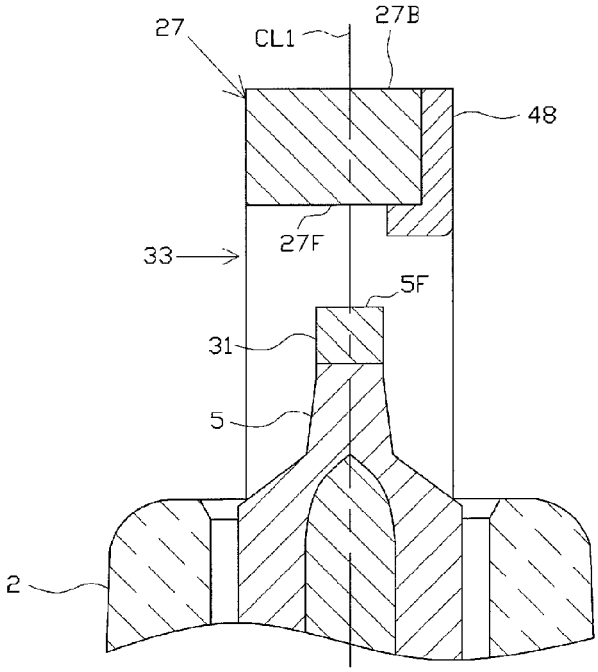
FIG. 17 Enlarged sectional view showing the configuration of a ground-electrode-side tip in another embodiment.
Figure 18:
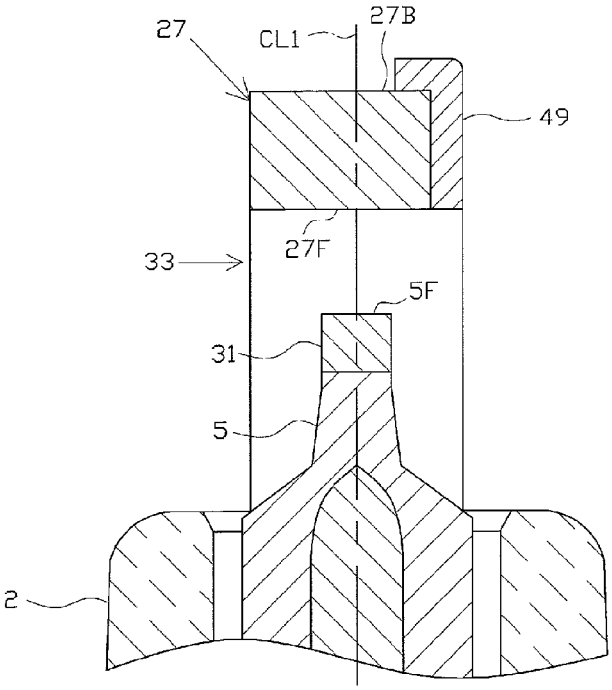
FIG. 18 Enlarged sectional view showing the configuration of a ground-electrode-side tip in a further embodiment.

(c) As shown in FIG. 17, a portion of a ground-electrode-side tip 48 may be disposed on the counter surface 27F of the ground electrode 27 located toward the center electrode 5. Also, as shown in FIG. 18, a portion of a ground-electrode-side tip 49 may be disposed on a back surface 27B of the ground electrode 27 located behind the counter surface 27F. Furthermore, portions of the ground-electrode-side tip may be disposed on the counter surface 27F and the back surface 27B, respectively. In this case, the strength of joining the ground-electrode-side tip to the ground electrode 27 can be further enhanced, whereby separation of the ground-electrode-side tip can be far more reliably prevented.

Figure 19:
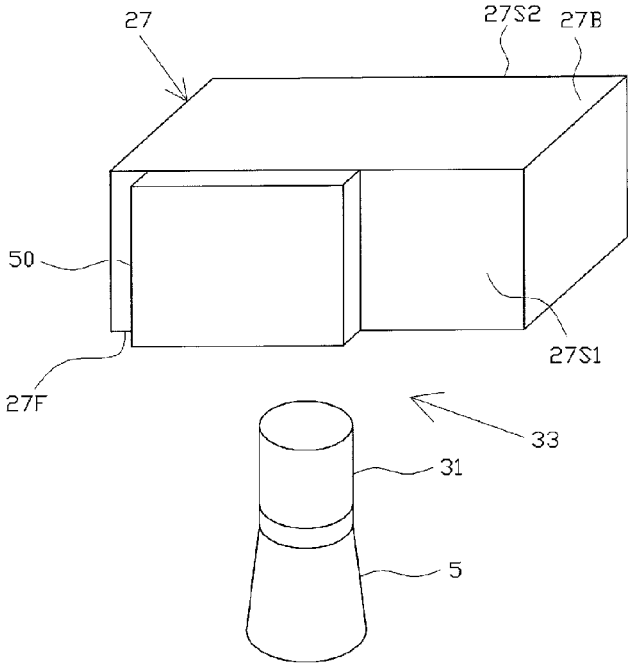
FIG. 19 Enlarged sectional view showing the configuration of a ground-electrode-side tip in a still further embodiment.
Figure 20:
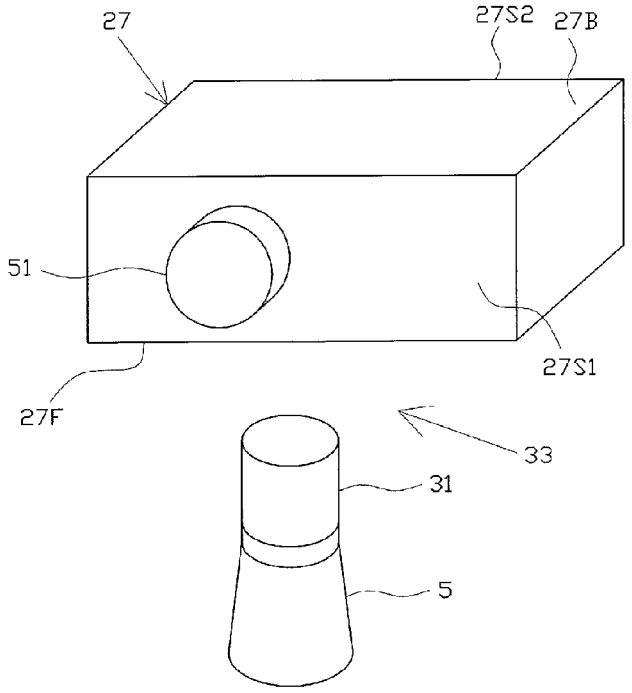
FIG. 20 Enlarged sectional view showing the configuration of a ground-electrode-side tip in yet another embodiment.

(d) In the above embodiment, the ground-electrode-side tip 32 is embedded in the ground electrode 27. However, as shown in FIGS. 19 and 20, the ground-electrode-side tips 50 and 51 may be provided such that at least a portion of each of the ground-electrode-side tips 50 and 51 protrudes from the side surface 27S1 of the ground electrode 27.

(e) In the above embodiment, the ground electrode 27 is formed of a single kind of metal. However, the ground electrode 27 may have a multilayer structure consisting of an outer layer, and an inner layer provided within the outer layer and formed of a metal having good thermal conductivity, such as copper or a copper alloy.

(f) In the above embodiment, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(g) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug
2: ceramic insulator (insulator)
3: metallic shell
4: axial hole
5: center electrode
5F: forward end surface (center electrode)
27: ground electrode
27B: back surface (ground electrode)
27F: counter surface (ground electrode)
27S1, 27S2: side surface (ground electrode)
32: ground-electrode-side tip (tip)
32A: discharge surface
33: gap
VS1: first imaginary plane (imaginary plane)
VS2: second imaginary plane
CL1: axial line
PR1: projected image of discharge surface

What is claimed is:

1. A spark plug comprising:
a tubular insulator having an axial hole extending therethrough in the direction of an axial line;
a center electrode inserted into a forward end portion of the axial hole;
a tubular metallic shell provided on an outer circumference of the insulator; and
a ground electrode disposed at a forward end portion of the metallic shell and adapted to form a gap in cooperation with a forward end portion of the center electrode;
the spark plug being characterized by further comprising a tip at least a portion of which is joined to at least the one of two side surfaces of the ground electrode which is disposed downstream with respect to fuel gas flow, and characterized in that
in an imaginary plane which contains a forward end surface of the center electrode and on which a discharge surface of the tip is projected along an axial line, at least a portion of a projected image of the discharge surface is located within a range of 2.5G from an outer circumference of the forward end surface of the center electrode, where G (mm) is a size of the gap.

2. A spark plug according to claim 1, wherein
the tip has a thickness of 0.1 mm or more, and
in a second imaginary plane which contains the side surface of the ground electrode provided with the tip and on which a portion of the tip located 0.1 mm or more from a surface of the tip joined to the ground electrode is projected from a direction orthogonal to the axial line, a projected image of the portion has an area of 0.1 $mm^2$ or more.

3. A spark plug according to claim 1, wherein a shortest distance from the forward end surface of the center electrode to the discharge surface of the tip along a direction orthogonal to the axial line is +1.5 mm or less, where, with respect to the forward end surface of the center electrode, a + direction is a downstream direction of the fuel gas flow, and a – direction is an upstream direction of the fuel gas flow.

4. A spark plug according to claim 1, wherein a portion of the tip is disposed on at least one of a counter surface of the ground electrode located toward the center electrode and a back surface of the ground electrode located behind the counter surface.

5. A spark plug according to claim 1, wherein a portion of the tip protrudes toward the center electrode from a counter surface of the ground electrode located toward the center electrode.

6. A spark plug according to claim 1, wherein the tip is joined only to the one of the two side surfaces of the ground electrode which is disposed downstream with respect to the fuel gas flow.

7. A spark plug mounting structure in the form of an internal combustion engine to which the spark plug according to claim 1 is mounted, characterized in that the tip is joined to at least the one of two side surfaces of the ground electrode which is disposed downstream with respect to the fuel gas flow.

* * * * *